US005647444A

United States Patent [19]

Williams

[11] Patent Number: 5,647,444

[45] Date of Patent: Jul. 15, 1997

[54] ROTATING BLOWOUT PREVENTOR

[76] Inventor: John R. Williams, 3816 Spring Mountain Rd., Fort Smith, Ark. 72901

[21] Appl. No.: 697,427

[22] Filed: Aug. 23, 1996

Related U.S. Application Data

[63] Continuation of Ser. No. 565,129, Nov. 30, 1995, abandoned, which is a continuation of Ser. No. 460,672, Jun. 2, 1995, abandoned, which is a continuation of Ser. No. 343,835, Nov. 22, 1994, which is a continuation of Ser. No. 248,467, May 24, 1994, abandoned, which is a continuation of Ser. No. 948,137, Sep. 18, 1992, abandoned.

[51] Int. Cl.[6] ..... E21B 33/06

[52] U.S. Cl. ..... 175/209; 166/84.1; 277/31

[58] Field of Search ..... 166/75.1, 77, 82, 166/84, 88, 120, 212, 242, 341; 175/195, 209; 277/31

[56] References Cited

U.S. PATENT DOCUMENTS

| | | | |
|---|---|---|---|
| 517,509 | 4/1894 | Williams . | |
| 1,157,644 | 10/1915 | London . | |
| 1,472,952 | 11/1923 | Anderson . | |
| 1,503,476 | 8/1924 | Childs et al. . | |
| 1,528,560 | 3/1925 | Myers et al. . | |
| 1,546,467 | 7/1925 | Bennett . | |
| 1,560,763 | 11/1925 | Collins . | |
| 1,700,894 | 2/1929 | Joyce et al. . | |
| 1,708,316 | 4/1929 | MacClatchie . | |
| 1,769,921 | 7/1930 | Hansen . | |
| 1,776,797 | 9/1930 | Sheldon . | |
| 1,813,402 | 7/1931 | Hewitt . | |
| 1,831,956 | 11/1931 | Harrington . | |
| 1,836,470 | 12/1931 | Humason et al. . | |
| 1,902,906 | 3/1933 | Seamark . | |
| 1,942,366 | 1/1934 | Seamark | 166/14 |
| 2,036,537 | 4/1936 | Otis | 255/1 |
| 2,071,197 | 2/1937 | Burns et al. | 286/26 |
| 2,124,015 | 7/1938 | Stone et al. | 166/15 |
| 2,126,007 | 8/1938 | Guiberson et al. | 255/1 |
| 2,144,682 | 1/1939 | MacClatchie | 255/1 |
| 2,163,813 | 6/1939 | Stone et al. | 166/14 |
| 2,165,410 | 7/1939 | Penick et al. | 255/1 |
| 2,170,915 | 8/1939 | Schweitzer | 286/16 |
| 2,170,916 | 8/1939 | Schweitzer et al. | 255/1 |
| 2,175,648 | 10/1939 | Roach | 166/14 |
| 2,176,355 | 10/1939 | Otis | 255/1 |
| 2,185,822 | 1/1940 | Young | 285/97.6 |
| 2,199,735 | 5/1940 | Beckman | 255/1 |
| 2,222,082 | 11/1940 | Leman et al. | 255/1 |
| 2,233,041 | 2/1941 | Alley | 166/14 |

(List continued on next page.)

*Primary Examiner*—Frank Tsay
*Attorney, Agent, or Firm*—Pravel, Hewitt, Kimball & Krieger

[57] ABSTRACT

A rotating blowout preventor having at least two rotating stripper rubber seals which provide a continuous seal about a drilling string having drilling string components of varying diameter. A stationary bowl is designed to support a blowout preventor bearing assembly and receives a swivel ball that cooperates with the bowl to self-align the blowout preventor bearing assembly and the swivel ball with respect to the fixed bowl. Chilled water is circulated through the seal boxes of the blowout preventor bearing assembly and liquid such as water is pumped into the bearing assembly annulus between the stripper rubbers to offset well pressure on the stripper rubbers. Lubricant is pumped into shaft bearings and serves to prolong the life of shaft. pressure seals by offsetting well pressure against the shaft pressure seals and clamp mechanisms are used to tighten the stripper rubbers on the respective mounting elements in the bearing assembly and swivel ball. A method for sealing a drilling string at the surface of a well, which method includes the steps of mounting a rotating blowout preventor having at least two sealing stripper rubbers on the well casing or other equipment connected to the well casing, in swiveling relationship, inserting a drilling string through the rotating blowout preventor and stripper rubbers, introducing a liquid into the rotating blowout preventor, circulating water around certain pressure seals and application of hydraulic pressure on the stripper rubbers and pressure seals to offset well pressure exerted against the stripper rubbers and pressure seals.

9 Claims, 4 Drawing Sheets

U.S. PATENT DOCUMENTS

| | | | |
|---|---|---|---|
| 2,243,340 | 5/1941 | Hild | 255/1 |
| 2,243,439 | 5/1941 | Pranger et al. | 255/1 |
| 2,287,205 | 6/1942 | Stone | 286/16 |
| 2,303,090 | 11/1942 | Pranger et al. | 255/19 |
| 2,313,169 | 3/1943 | Penick et al. | 166/14 |
| 2,325,556 | 7/1943 | Taylor, Jr. et al. | 309/4 |
| 2,338,093 | 6/1944 | Caldwell | 255/23 |
| 2,480,955 | 9/1949 | Penick | 235/22 |
| 2,506,538 | 5/1950 | Bennett | 255/23 |
| 2,529,744 | 11/1950 | Schweitzer | 286/16 |
| 2,609,836 | 9/1952 | Knox | 137/618 |
| 2,628,852 | 2/1953 | Voytech | 286/11.14 |
| 2,646,999 | 7/1953 | Barske | 286/9 |
| 2,649,318 | 8/1953 | Skillman | 286/19 |
| 2,731,281 | 1/1956 | Knox | 286/16.1 |
| 2,746,781 | 5/1956 | Jones | 288/2 |
| 2,760,750 | 8/1956 | Schweitzer, Jr. et al. | 251/2 |
| 2,760,795 | 8/1956 | Vertson | 286/11.15 |
| 2,808,229 | 10/1957 | Bauer et al. | 255/2.5 |
| 2,808,230 | 10/1957 | McNeill et al. | 255/2.5 |
| 2,846,178 | 8/1958 | Minor | 251/2 |
| 2,846,247 | 11/1958 | Davis | 166/84 |
| 2,853,274 | 9/1958 | Collins | 255/23 |
| 2,904,357 | 9/1959 | Knox | 286/16.1 |
| 2,927,774 | 3/1960 | Ormsby | 255/23 |
| 2,995,196 | 8/1961 | Gibson et al. | 175/7 |
| 3,023,012 | 2/1962 | Wilde | 277/31 |
| 3,029,083 | 4/1962 | Wilde | 277/164 |
| 3,052,300 | 9/1962 | Hampton | 166/84 |
| 3,128,614 | 4/1964 | Auer | 64/23.5 |
| 3,216,731 | 11/1965 | Dollison | 277/1 |
| 3,225,831 | 12/1965 | Knox | 166/75 |
| 3,268,233 | 8/1966 | Brown | 277/31 |
| 3,285,352 | 11/1966 | Hunter | 175/214 |
| 3,323,773 | 6/1967 | Walker | 251/1 |
| 3,387,851 | 6/1968 | Cugini | 277/2 |
| 3,400,938 | 9/1968 | Williams | 277/31 |
| 3,472,518 | 10/1969 | Harlan | 277/31 |
| 3,492,007 | 1/1970 | Jones | 277/31 |
| 3,529,835 | 9/1970 | Lewis | 277/2 |
| 3,621,912 | 11/1971 | Wooddy, Jr. | 166/0.5 |
| 3,667,721 | 6/1972 | Vujasinovic | 251/1 |
| 3,724,862 | 4/1973 | Biffle | 277/31 |
| 3,868,832 | 3/1975 | Biffle | 64/23.5 |
| 3,934,887 | 1/1976 | Biffle | 277/31 |
| 3,965,987 | 6/1976 | Biffle | 166/315 |
| 4,098,341 | 7/1978 | Lewis | 175/195 X |
| 4,143,880 | 3/1979 | Bunting et al. | 277/31 |
| 4,143,881 | 3/1979 | Bunting | 277/31 |
| 4,154,448 | 5/1979 | Biffle | 277/31 |
| 4,157,186 | 6/1979 | Murray et al. | 277/31 |
| 4,208,056 | 6/1980 | Biffle | 277/31 |
| 4,281,724 | 8/1981 | Garrett | 175/195 |
| 4,285,406 | 8/1981 | Garrett | 175/195 |
| 4,293,047 | 10/1981 | Young | 175/195 |
| 4,304,310 | 12/1981 | Garrett | 175/195 |
| 4,312,404 | 1/1982 | Morrow | 166/84 |
| 4,361,185 | 11/1982 | Biffle | 166/84 |
| 4,363,357 | 12/1982 | Hunter | 166/84 |
| 4,367,795 | 1/1983 | Biffle | 166/84 |
| 4,383,577 | 5/1983 | Pruitt | 166/95 |
| 4,398,599 | 8/1983 | Murray | 166/84 X |
| 4,406,333 | 9/1983 | Adams | 175/209 |
| 4,416,340 | 11/1983 | Bailey | 175/195 |
| 4,423,776 | 1/1984 | Wagoner | 166/84 |
| 4,441,551 | 4/1984 | Biffle | 166/84 |
| 4,444,401 | 4/1984 | Roche et al. | 166/84 X |
| 4,448,255 | 5/1984 | Shaffer et al. | 166/387 |
| 4,480,703 | 11/1984 | Garret | 175/195 |
| 4,486,025 | 12/1984 | Johnston | 277/31 |
| 4,526,243 | 7/1985 | Young | 175/195 |
| 4,529,210 | 7/1985 | Biffle | 277/31 |
| 4,531,580 | 7/1985 | Jones | 166/84 |
| 4,745,970 | 5/1988 | Bearden | 165/84 |
| 4,754,820 | 7/1988 | Watts et al. | 175/195 |
| 4,783,084 | 11/1988 | Biffle | 277/9 |
| 4,825,938 | 5/1989 | Davis | 166/84 |
| 4,828,024 | 5/1989 | Roche | 166/84 |
| 4,949,796 | 8/1990 | Williams | 175/209 |
| 5,022,472 | 6/1991 | Bailey et al. | 175/195 |
| 5,137,084 | 8/1992 | Gonzales et al. | 166/84 |
| 5,178,215 | 1/1993 | Yenulis et al. | 166/80 |
| 5,213,158 | 5/1993 | Bailey et al. | 166/82 |
| 5,224,557 | 7/1993 | Yenube et al. | 175/195 |

TO FIG. 2B

ROTATING BLOWOUT PREVENTOR

CROSS-REFERENCE TO RELATED APPLICATION

The invention relates to U.S. patent application Ser. No. 07/954,285 filed on Sept. 30, 1992 entitled "Rotating Blowout Preventor," which remains pending through a series of file wrapper continuations.

This is a continuation of application Ser. No. 08/565,129 filed on Nov. 30, 1995 which is a continuation of application Ser. No. 08/460,672 filed on Jun. 2, 1995 which is a continuation of application Ser. No. 08/343,835 filed on Nov. 22, 1994 which is a continuation of application Ser. No. 08/248,467 filed on May 24, 1994 which is a continuation of application Ser. No. 07/948,137 filed on Sep. 18, 1992 which are now all abandoned.

BACKGROUND OF THE INVENTION

FIELD OF THE INVENTION

This invention relates to drilling heads and blowout preventors for oil and gas wells and more particularly, to a rotating blowout preventor mounted oil the wellhead or on primary blowout preventors bolted to the wellhead, to pressure-seal the interior of the well casing and permit forced circulation of drilling fluid through the well during drilling operations. The rotating blowout preventor of this invention includes a bowl which is designed to receive a blowout preventor bearing assembly and a swivel ball mounted in the bowl, to self-align the blowout preventor bearing assembly and swivel ball with respect to the bowl. A conventional drilling string is inserted or "stabbed" through the blowout preventor bearing assembly and swivel ball, which include at least two base stripper rubber units rotatably mounted in the blowout preventor bearing assembly and swivel ball to seal the drilling string. The device is designed such that chilled water may be circulated through certain pressure seals in the blowout preventor bearing assembly and liquid such as water may also be pumped directly into the bearing assembly between the stripper rubber seals, to hydraulically offset well pressure on the stripper rubber seals. Lubricant is introduced into stacked shaft bearings and also serves to offset well pressure exerted against key shaft pressure seals. The stripper rubber seals are attached to rotating mounting elements of the blowout preventor bearing assembly by means of clamp mechanisms.

Primary features of the rotating blowout preventor of this invention include the circulation of chilled water through the top seal box on the one hand, and pumping water or other liquid into the blowout preventor on the other hand, to both cool the pressure seals in the seal boxes and internally and hydraulically pressurize the spaced rotating stripper rubbers and facilitate offsetting higher well pressure on the stripper rubbers. A second primary feature is clamping of the respective stripper rubbers to the pot lid of the rotating top rubber pot and to the rotating shaft, respectively, to facilitate rapid assembly and disassembly. Another primary feature is swivel mounting of the blowout preventor bearing assembly on the fixed bowl to facilitate self-alignment of the blowout preventor bearing assembly with respect to the bowl and drilling string during drilling or other well operations. Still another important feature is lubrication of top and bottom bearings and offsetting well pressure on key shaft pressure seals by introducing lubricant into the bearing assembly. Another primary feature of the invention is the provision of a double split kelly driver design.

Oil, gas, water and geothermal wells are typically drilled with a drill bit connected to a hollow drill string which is inserted into a well casing cemented in the well bore. A drilling head is attached to the well casing, wellhead or to associated blowout preventor equipment, for the purposes of sealing the interior of the well casing from the surface and facilitating forced circulation of drilling fluid through the well while drilling. In the more commonly used forward circulation drilling technique, drilling fluid is pumped downwardly through the bore of the hollow drill string, out the bottom of the bore and then upwardly through the annulus defined by the drill string and the interior of the well casing and subsequently, from a side outlet above the well head. In reverse circulation, the drilling fluid is pumped directly through a side outlet, into the annulus between the drill string and the well casing and subsequently upwardly through the drill string bore and from the well.

Prior art drilling heads typically include a stationary body which carries a rotatable spindle operated by a kelly apparatus. One or more seals or packing elements, sometimes referred to as stripper packers or stripper rubbers, is carried by the spindle to seal the periphery of the kelly or the drive tube or sections of the drill pipe, whichever may be passing through the spindle, and thus confine the fluid pressure in the well casing to prevent the drilling fluid from escaping between the rotating spindle and the drilling string. As modern wells are drilled to ever deeper depths, greater temperature and pressures are encountered at the drilling head. These rigorous drilling conditions pose increased risks to rig personnel from accidental scalding, burns or contamination by steam, hot water and hot, caustic well fluids.

DESCRIPTION OF THE PRIOR ART

Among the patents which relate to rotating blowout preventors are the following: U.S. Pat. No. 4,783,084, dated Nov. 8, 1988, to Biffle; U.S. Pat. No. 3,965,987, dated Jun. 29, 1976, also to Biffle; U.S. Pat. No. 3,868,832, dated Mar. 4, 1975, also to Biffle; U.S. Pat. No. 4,406,333, dated Sep. 27, 1983 to Adams; U.S. Pat. No. 4,423,776, dated Jan. 3, 1984, to Wagoner, et al; U.S. Pat. No. 4,304,310, dated Dec. 8, 1981, to Garrett; U.S. Pat. No. 4,157,186, dated Jun. 5, 1979, to Murray, et al; U.S. Pat. No. 4,312,404, dated Jan. 26, 1982, to Morrow; U.S. Pat. No. 4,398,599, dated Aug. 16, 1983, to Murray; and U.S. Pat. No. 3,128,614, dated Apr. 14, 1964, to L. S. Auer.

It is an object of this invention to provide a rotating blowout preventor which is characterized by a blowout preventor bearing assembly and tilt ball having an improved double split kelly driver design end mounted in tiltable relationship to a bowl attached to the well casing, wellhead or other blowout preventor equipment, to facilitate self-alignment of the blowout preventor bearing assembly and tilt ball with respect to the drill string while drilling or servicing the well.

Another object of this invention is to provide a dual stripper rubber rotating blowout preventor for containing internal well pressure at the well head, which rotating blowout preventor includes fluid ports communicating with selected pressure seals and/or the interior of the blowout preventor bearing assembly, for cooling and exerting pressure on the pressure seals and/or a pair of spaced, rotating stripper rubbers and offsetting well pressure application to the pressure seals and/or stripper rubbers, to minimize deformation and failure of the pressure seals and/or stripper rubbers.

A still further object of this invention is to provide a new and improved rotating blowout preventor which is characterized by a blowout preventor bearing assembly and swivel ball fitted with at least two vertically spaced stripper rubber seals, the top stripper rubber seal of which is attached to the pot lid of a rotating top rubber pot by means of a clamp and the bottom stripper rubber secured to a rotating shaft in the blowout preventor swivel ball by means of a second clamp, which clamps are capable of tightening the respective stripper rubbers to a desired degree for more favorable and rapid installation, disassembly and pressure-sealing purposes.

Yet another object of this invention is to provide a method for sealing a drilling string at the surface of a well having a casing, which method includes; the steps of mounting a rotating blowout preventor having at least two sealing stripper rubbers, on the well casing, wellhead or other equipment connected to the well casing or wellhead, in swiveling relationship, inserting or "stabbing" a drilling string through the bearing assembly and swivel ball elements of the rotating blowout preventor, including the stripper rubbers, such that the swivel ball and bearing assembly aligns with the drilling string, introducing a liquid into the rotating blowout preventor and circulating chilled water through certain pressure seals for cooling the pressure seals and applying hydraulic pressure on the stripper rubbers and pressure seals to offset well pressure exerted against the stripper rubbers and pressure seals.

SUMMARY OF THE INVENTION

These and other objects of the invention are provided in a rotating blowout preventor and method for containing the internal pressure of a well at the well head during drilling or operation of the well, which rotating blowout preventor includes, in a most preferred embodiment, a blowout preventor bearing assembly and swivel ball having an improved double-split kelly driver design and mounted in swivel fashion on a fixed bowl attached to the well casing, wellhead or primary blowout preventor, a vertical shaft rotatably mounted in the bearing assembly and swivel ball, fluid and lubricating inlet ports communicating with the top shaft seal boxes for circulating chilled water through the top seal box and lubricant to stacked shaft bearings and exerting internal pressure on the shaft pressure seals and pumping water through the bearing assembly and swivel ball to spaced, rotating stripper rubbers mounted on the shaft, to offset external well pressure, and further including clamps for clamping the stripper rubbers to the shaft and other mounting elements in the blowout preventor bearing assembly to facilitate better sealing and optimum assembly and disassembly of the stripper rubbers.

BRIEF DESCRIPTION OF THE DRAWINGS

The invention will be better understood by reference to the accompanying drawings, wherein:

FIG. 3 is an enlarged sectional view of a preferred water inlet assembly provided in the blowout preventor assembly carrier for injecting water or other fluid into the interior of the blowout preventor assembly and offsetting internal well pressure; and FIG. 4 is an enlarged sectional view of a preferred barrel groove located in the barrel element of the blowout preventor assembly carrier for lifting and handling purposes.

DESCRIPTION OF THE PREFERRED EMBODIMENTS

Figure 1:
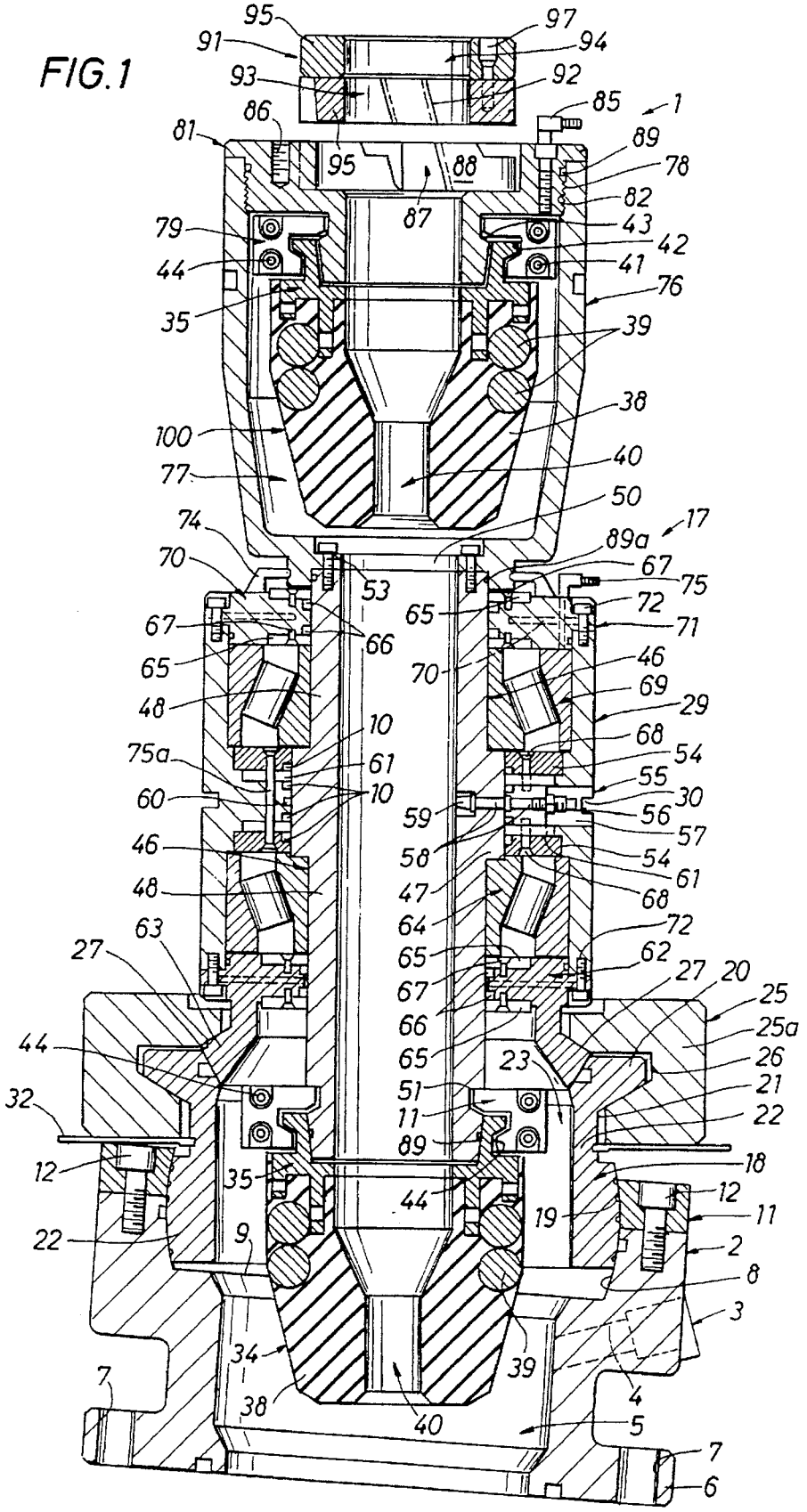
FIG. 1 is a side sectional view of a preferred embodiment of the rotating blowout preventor of this invention.
Figure 2A:
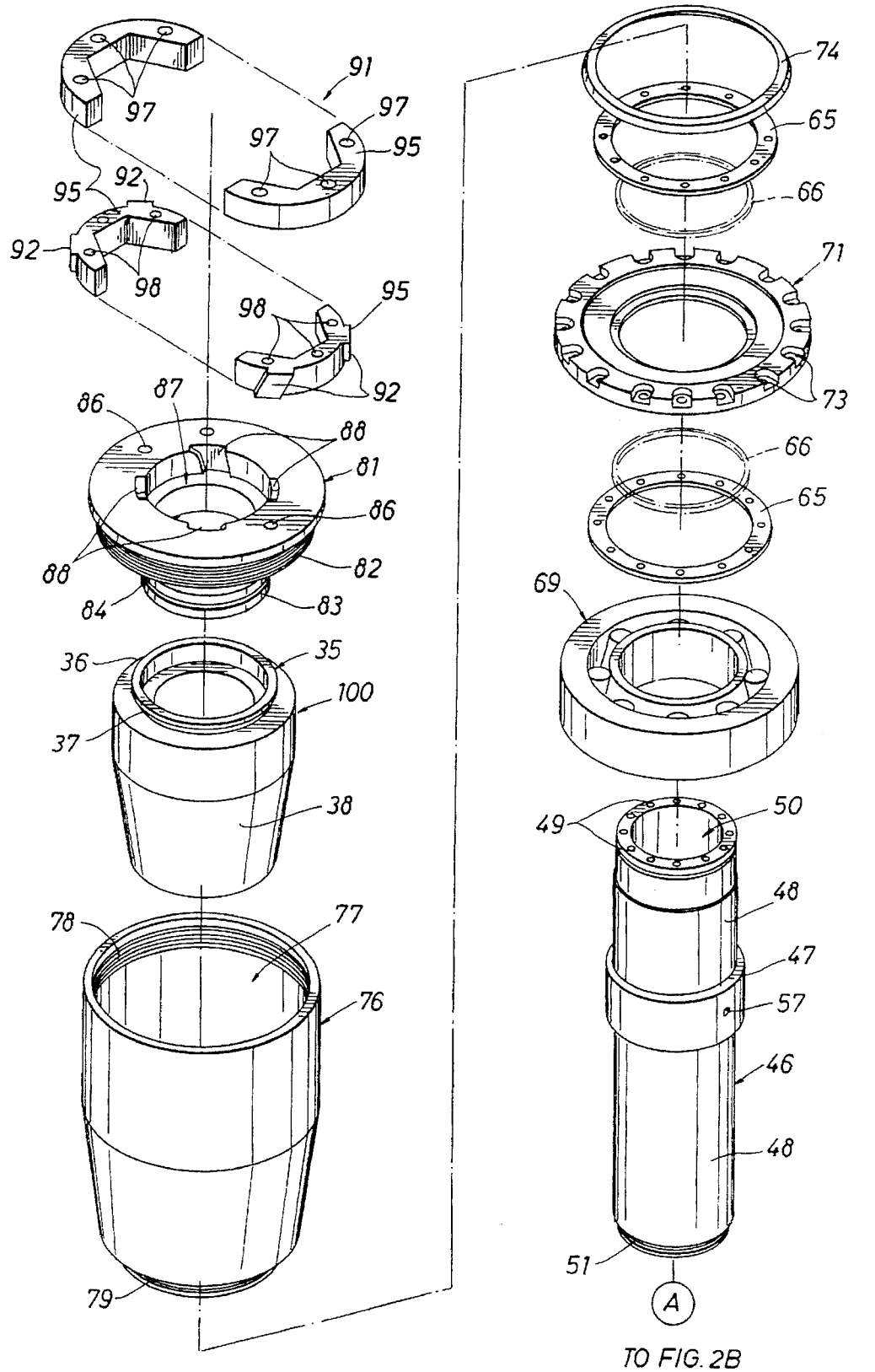
FIG. 2A is an exploded view of the top portion of the blowout preventor assembly carrier element of the rotating blowout preventor illustrated in FIG. 1.
Figure 2B:
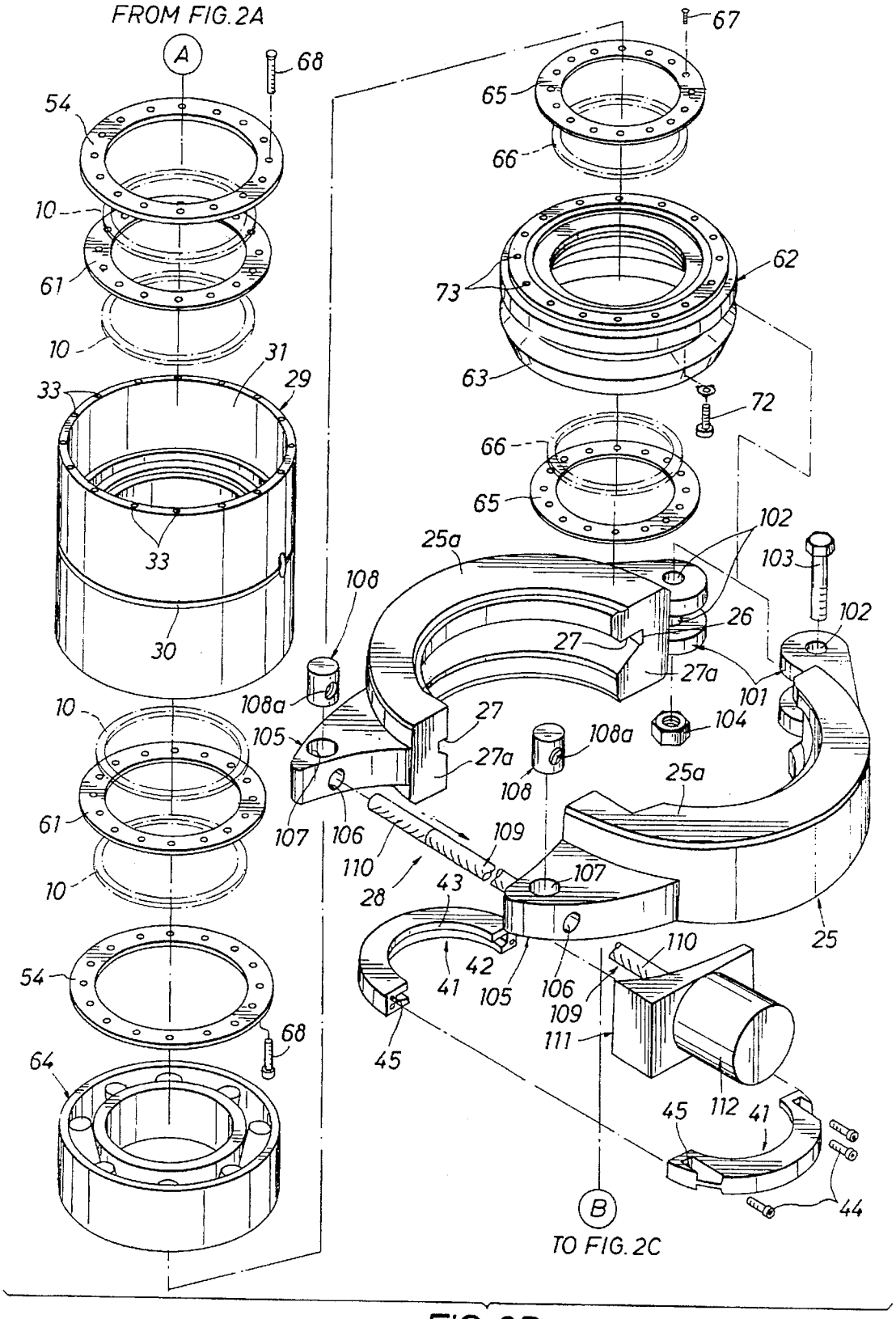
FIG. 2B is an exploded view of the center portion of blowout preventor assembly carrier element of the rotating blowout preventor illustrated in FIG. 1.
Figure 2C:
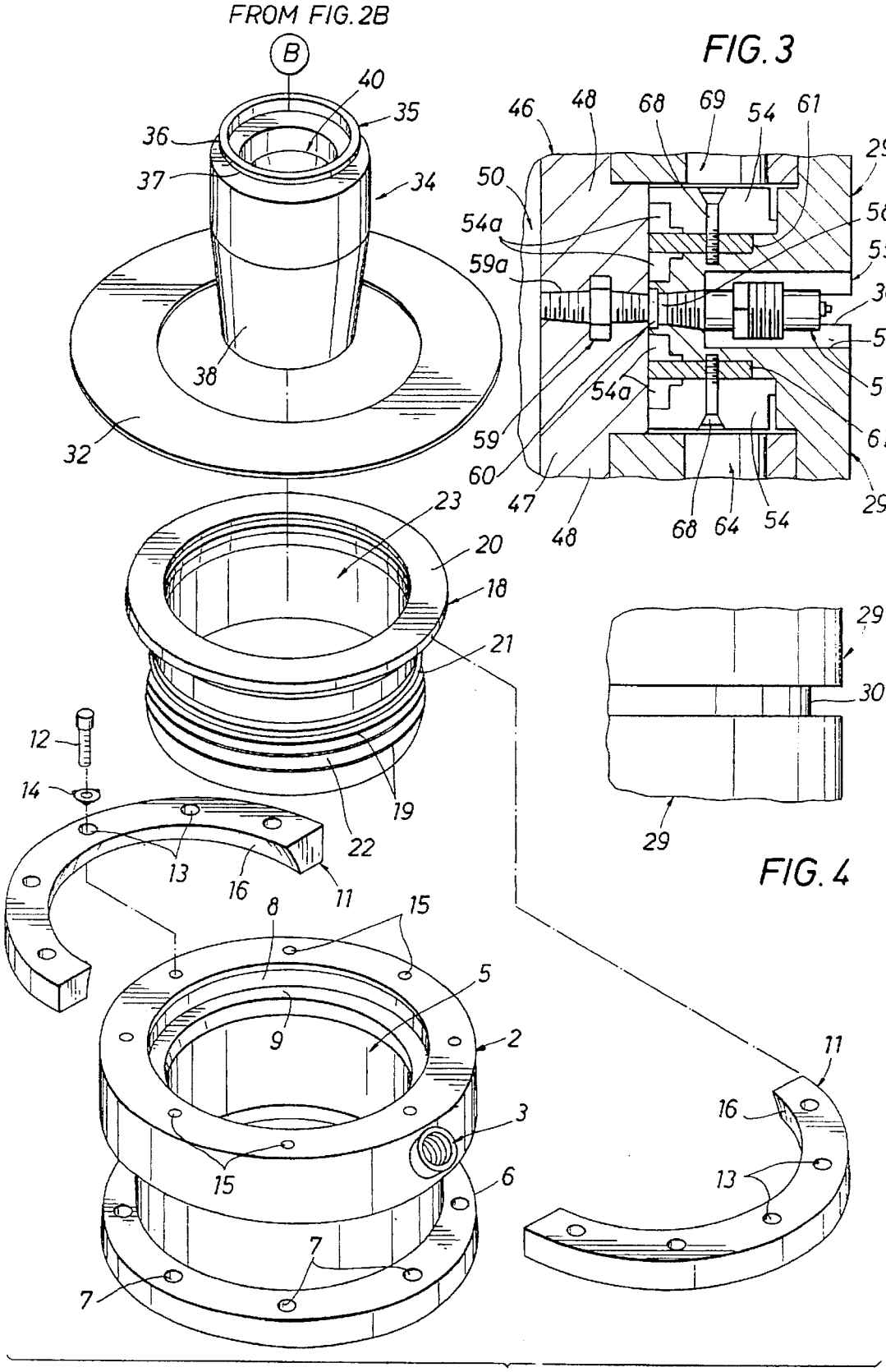
FIG. 2C is an exploded view of the lower portion of the rotating blowout preventor 1 illustrated in FIG. 1, including the fixed bowl.

Referring initially to FIGS. 1 and 2A–2C, in a preferred embodiment the rotating blowout preventor of this invention is generally illustrated by reference numeral 1. The rotating blowout preventor 1 is characterized by a bowl 2, which is mounted on a conventional casing, wellhead or primary blowout preventor equipment (not illustrated) of a well (not illustrated) according to the knowledge of those skilled in the art. The bowl 2 is characterized by a mud fill line 3, having a mud fill line bore 4 for injecting drilling mud (not illustrated) into the bowl bore 5 of the bowl 2 and circulating the drilling mud through the drill string annulus and drill string (not illustrated), further according to the knowledge of those skilled in the art. An outlet flange (not illustrated) may also be provided in the bowl 2 in conventional fashion for diverting well bore debris, according to the knowledge of those skilled in the art. Bowl flange openings 7 are provided in the conventional bowl flange 6 for bolting the bowl 2 to the casing, wellhead or blowout preventor. A concave ball seat 8, fitted with a ball seal 24, is provided in the top portion of the bowl 2 and terminates at a flat ball seat shoulder 9, located in the upper end of the bowl 2, as illustrated in FIGS. 1 and 2C. As further illustrated in FIGS. 1 and 2C, a swivel ball 18 and connected bearing assembly 17 are mounted on the bowl 2 and the ball 18 is characterized by a convex ball 22, fitted with multiple, spaced, grease-retaining grooves 19, such that the ball 22 fits in the ball seat 8 of the bowl 2 and facilitates tilting of the entire bearing assembly 17 and swivel ball 18 with respect to the fixed bowl 2, as illustrated in FIG. 1, for a self-aligning purpose which will be hereinafter further described. The swivel ball 18 is terminated at the top by a ball flange 20 and is also fitted with a ball groove 21, located intermediate the ball flange 20 and the ball 22, to facilitate insertion of the ball flange 20 in the circular bowl clamp groove 26, provided in the semicircular clamp segments 25*a* of a bowl clamp 25. The bevelled, circular groove shoulder 27 of the clamp segments 25*a* also engages the bottom seal box shoulder 63 of a bottom seal box 62, to removably secure the bottom seal box 62, as well as the upper elements of the bearing assembly 17, to the swivel ball 18 by operation of a clamp lock 28, provided on the bowl clamp 25. The clamp lock 28 is detailed in FIG. 2B and includes a pair of interlocking bowl clamp hinges 101, having registering hinge pin openings 102 for receiving a hinge bolt 103 and companion nut 104, to effect hinged operation of the clamp segments 25*a*. A pair of clamp flanges 105 are provided on the opposite, unhinged ends of the clamp segments 25*a* and include horizontal, aligned lead screw openings 106 and vertical lead nut openings 107, to accommodate a lead screw 109 and a pair of lead nuts 108, respectively. The lead screw 109 is provided with lead screw threads 110, which engage the nut threads 108*a* of the two aligned lead nuts 108 when the lead nuts 108 are inserted in the respective lead nut openings 107 and the lead screw 109 is inserted in the lead screw openings 106 of the respective clamp flanges 105, as illustrated. A reversible hydraulic motor 112 is mounted on a hydraulic motor mount 111, welded or otherwise secured to one of the clamp segments 25*a*, for rotating the lead screw 109 and tightening or loosening the bowl clamp 25 on the swivel ball 18 and the bottom seal box 62. Accordingly, it will be appreciated from a consideration of FIGS. 1 and 2B that downward pressure may be applied to the bevelled bottom seal box shoulder 63 of the bottom seal box 62 and upward pressure applied to the bevelled ball flange 20 of the swivel ball 18 by operating the clamp lock 28 and tightening the bowl clamp 25 using the hydraulic motor 112. Mounting of the upper portion of the bearing assembly 17 to the swivel ball 18 in this manner allows the entire bearing assembly 17 and swivel ball 18 to rock or tilt with a vertical misalignment of up to about 3 degrees with respect to the bowl 2, as well as the swivel ball retaining ring 11, which is bolted to the bowl 2 by means of retaining ring bolts 12, that project through lock washers 14 and retaining ring bolt openings 13, to seat in the respective threaded bolt openings 15 provided in the bowl 2, as further illustrated in FIGS. 1 and 2C. This swiveling capability allows the bearing assembly 17 and swivel ball 18 to move in concert with respect to the bowl 2 and fixed bowl retaining ring 11, to align with a drilling string (not illustrated) when the drilling string is "stabbed" through the bearing assembly 17 and swivel ball 18. The bowl retaining ring 11 is also fitted with a concave retaining ring seat 16 which extends the socket 8 in the bowl 2, to accommodate the upper portion of the ball 22 in the swivel ball 18. In a most preferred embodiment of the invention a bottom dust shield 32 is disposed between the bowl retaining ring 11 and the bowl clamp 25 and is seated in a slot or ring groove (not illustrated) provided at the ball groove 21 in the swivel ball 18. The bottom dust shield 32 serves to minimize the accumulation of dust, grit or dirt in the space between the top surface of the bowl retaining ring 11 and the bottom surface of the bowl clamp 25 when the bearing assembly 17 and swivel ball 18 rock or swivel with respect to the stationary bowl retaining ring 11 and bowl 2. The swivel ball 18 is fitted with a swivel ball bore 23, which communicates with the bowl bore 5 of the bowl 2 and accommodates a bottom stripper rubber 34, characterized by a rubber body 38, molded with an internal body spring 39 for stiffening purposes and fitted with a metal insert 35, having an insert shoulder 36 and an insert groove 37 for receiving a bottom stripper rubber clamp 41, as further illustrated in FIGS 1 and 2B. It will be appreciated from a consideration of the drawings that the rubber body 38 is molded into the rubber insert 35 such that these two parts essentially form one piece and a stripper rubber bore 40, extending vertically through the bottom stripper rubber 34, tapers from a large diameter at the upper end of the bottom stripper rubber 34 adjacent the metal insert 35, to a more narrow diameter at bottom of the rubber body 38. The bottom stripper rubber clamp 41 is provided with clamp bolts 44, extending through clamp openings 45 in the clamp elements and is configured with a stripper rubber clamp groove 42, to facilitate engagement of the bevelled stripper rubber clamp shoulder 43 and the bevelled shaft clamp groove 51, provided in the shaft body 48 of a vertically-oriented, rotatable shaft 46. This arrangement secures the metal insert 35 and rubber body 38 to the bottom portion of the shaft 46 in tightly clamping, adjustable and removable relationship, as further illustrated in FIG. 1. An 0-ring seal 89 is provided in a shaft groove (not illustrated) of the shaft 46 at the metal insert 35, to seal the interface between the shaft body 48 and the metal insert 35. The shaft 46 is further provided with vertical shaft bore 50 and an enlarged, central shaft collar 47, located intermediate the top and bottom ends of the shaft body 48 and shaft bolt openings 49 are provided in the top end of the shaft body 48 in spaced relationship to receive multiple shaft bolts 53, for mounting a top rubber pot 76 to the top end of the shaft body 48, as further illustrated in FIG. 1 with O-ring seal 89A located between the shaft body 48 and top pot 76. A top bearing 69 and bottom bearing 64 are seated on the shaft body 48 of the shaft 46 at each end of the shaft collar 47, as further illustrated in FIGS. 1, 2A and 2B. The bottom bearing 64 is secured in position by means of the bottom seal box 62, which includes a pair of bottom seal retainer 65 and a pair of outside shaft pressure seals 66, connected by retainer bolts 67, while the top bearing 69 is mounted on the top portion of the shaft body 48 by means of a top seal box 71, also fitted with a pair of bearing seal retainer 65 and a pair of outside shaft pressure seals 66, secured by retainer bolts 67. The top seal box 71 and bottom seal box 62 are, in turn, secured to a fixed barrel 29 by means of seal box bolts 72, which extend through box bolt openings 73 provided in the top seal box 71 and bottom seal box 62, respectively, and engage threaded barrel bolt openings 33, located in the top and bottom margins of the barrel 29, respectively. The spaced top bearing 69 and bottom bearing 64 are seated, respectively, in upper and lower bearing seats 31, provided in the barrel 29, as illustrated in FIG. 2B. A barrel groove 30 is provided in the circumference of the barrel 29 for lifting and handling purposes.

Referring now to FIGS. 1 and 3 of the drawings, in a preferred embodiment of the invention the barrel 29 and shaft 46 are provided with a water inlet assembly 55, which includes a quick disconnect fitting 56, recessed in a quick disconnect port 57 and threaded in the barrel 29 in communication with a water inlet port 58. The water inlet port 58 communicates with a water supply groove 60, illustrated in FIG. 3 and with a check valve 59, seated in a check valve port **59*a*, provided in the shaft collar 47 of the shaft 46. The water inlet 58 communicates with the continuous circumferential water supply groove 60 to facilitate pumping water or other fluid through the quick disconnect fitting 56 and water inlet port 58 to the water supply groove 60 and through checkvalve 59 and checkvalve port 59A and pressurizing the annulus between a drilling string (not illustrated) extending vertically through the shaft bore 50 and the inside wall of the shaft 46, to apply hydraulic pressure on the bottom stripper rubber 34 and a top stripper rubber 100, for purposes which will be hereinafter further described. Leakage of water or other fluid from the water inlet port 58 and water supply groove 60 back into the bearing assembly 17 is prevented by the inside set of middle shaft pressure seals 54*a*, which are installed in pairs on each side of a pair of corresponding metal seal spacers 61, which seal assembly spans the water supply groove 60. The outside sets of middle shaft pressure seals 54*a* act as oil seals to prevent lubricant introduced into the top bearing 69 and bottom bearing 64 through the lubricant injection fitting 75 and oiler 75*a*, from leaking into the water inlet port 58. Chilled water is also circulated through the top seal box 71 and/or the bottom seal box 62 through suitable fittings (not illustrated) mounted in the seal box water ports 70, also for purposes which will be hereinafter described. The seal spacers 61 and middle shaft pressure seals 54*a* are maintained in functional position by seal bolts 68, extending adjacent to the spaced oilers 75*a* in the bolt rings 54 and threaded into the barrel 29 in facing relationship, as illustrated in FIGS 1 and 3**.

Referring again to FIGS. 1 and 2A of the drawings, a top dust shield 74 is provided on the top seal box 71 and engages a circumferential groove (not illustrated) provided in the base of the rotatable top rubber pot 76 to prevent dirt or grime from accumulating on the top surface of the top seal box 71. Furthermore, the top stripper rubber 100 is located in the pot chamber 77 of the top rubber pot 76, and, like the bottom stripper rubber 34, is characterized by a metal insert 35, having an insert shoulder 36, defined by an insert groove 37, to which is molded a rubber body 38, encapsulating an internal body spring 39. A tapered stripper rubber bore 40 is also provided inside the rubber body 38 and tapers from a small diameter at the rubber body 38, upwardly to a larger diameter adjacent the rubber insert 35. The rotatable top rubber pot 76 is fitted with internal pot threads 78 for receiving corresponding external pot lid threads 82 of the pot lid 81 and securing the pot lid 81 to the top rubber pot 76. The mating elements of a top stripper rubber clamp 79 are provided with a stripper rubber clamp groove 42 and a stripper rubber clamp shoulder 43 and, like the bottom stripper rubber clamp 41, serve to releasably, but tightly, secure the rubber insert 35 and attached rubber body 38 of the top stripper rubber 100 to the nipple shoulder 84, shaped on the clamp nipple 83 of the pot lid 81, by means of the clamp bolts 44, as further illustrated in FIG. 1. The pot lid 81 is further characterized by break stud openings 86, a pressure check and pressure bleed valve 85 for monitoring and bleeding air pressure above the top stripper rubber clamp 79 from the annulus defined by the drilling string (not illustrated) and the inside surface of the shaft 46, between the bottom stripper rubber 34 and the top stripper rubber 100, and a kelly drive receptacle 87, which is shaped to define spaced lug receptacles 88. The lug receptacles 88 are designed to receive corresponding driver lugs 92, provided in a cooperating kelly driver 91, which, in a most preferred embodiment, includes two sets of split driver elements 95, connected by element bolts (not illustrated) that project through top bolt openings 97 and seat in corresponding threaded bolt openings 98. When assembled, the kelly driver 91 has a driver bore 94 and a driver receptacle 93 that communicates with the kelly driving receptacle 87 of the pot lid 81. An O-ring seal 89 is inserted in a ring groove (not illustrated) in the pot lid 81 for sealing the pot lid 81 on the top rubber pot 76.

In operation, the bowl 2 of the rotating blowout preventor 1 is first bolted to the casing, wellhead or primary blowout preventor of a well, in conventional fashion. The grease retaining grooves 19 of the ball 22 have been filled with grease and the ball 18 has been lowered onto the bowl 2, such that the ball 22 of the swivel ball 18 coincides with the concave socket 8 of the bowl 2 and is sealed in this position by the ball seal 24. Furthermore, the two semicircular segments of the bowl retaining ring 11 have been fitted over the swivel ball 18 and matched with the bowl 2, such that the retaining ring bolts 12 can be inserted to join the bowl retaining ring 11 to the bowl 2. The bearing assembly 17 is then lowered onto the ball flange 20 of the swivel ball 18, such that the bearing assembly 17 and swivel ball 18 are thus securely and sealingly, but tiltably, mounted to the fixed bowl 2 and bowl retaining ring 11, by operation of the bowl clamp 25, as illustrated in FIG. 1. It will be appreciated that the bearing assembly 17 and swivel ball 18 have been previously assembled from the various components as described above, such that a drilling string (not illustrated) may be inserted or "stabbed" through the hollow center of the bearing assembly 17 and the bottom stripper rubber 34 and top stripper rubber 100 prior to installation on the swivel ball 18, bowl retaining ring 11 and bowl 2. More specifically, the drilling string is guided through the kelly driver receptacle 87 of the pot lid 81, the stripper rubber bore 40 of the top stripper rubber 100, the shaft bore 50 of the shaft 46, the stripper rubber bore 40 of the bottom stripper rubber 34 and finally, through the swivel assembly bore 23 of the swivel ball 18 and the bowl bore 5 of the bowl 2, into the well. It will be appreciated that the bearing assembly 17 and swivel ball 18 are self-aligning with respect to the fixed bowl 2 and bowl retaining ring 11 during the drilling string and drill bit stabbing operation, as well as during the well drilling procedure, by virtue of the swiveling effect of the swivel ball 18. After the drilling string and drill bit have been inserted through the blowout preventor bearing assembly 17, swivel ball 18 and bowl 2 into the well casing, drilling may be accomplished by operating a conventional kelly apparatus (not illustrated) and driving the kelly driver 91, which has been disassembled and reassembled around the conventional kelly (not illustrated) to begin rotation of the top rubber pot 76, top stripper rubber 100, the shaft 46 and the bottom stripper rubber 34 with respect to the barrel 29, bowl clamp 25, bowl 2 and bowl retaining ring 11, during the drilling operation. If high pressures are expected prior to initiating drilling, water or other liquid may be pumped by means of a suitable water pump through the quick disconnect fitting 56, the water inlet port 58, water supply groove 60 and the check valve 59, into the annulus in the shaft bore 50, to pressurize the annulus, the top stripper rubber 100 and the bottom stripper rubber 34. Trapped air is bled from the annulus through the pressure check and pressure bleed valve 85. Water is thus injected through the fixed barrel 29 and into the shaft 46 by continuously filling the rotating continuous water supply groove 60, milled into the inside surface of the barrel 29. Pressurizing of the water supply groove 60 insures continuous pressurizing of the annulus in the shaft bore 50 and the outside of the top stripper rubber 100 and inside of the bottom stripper rubber 34. This internal hydraulic pressurization ensures that external well pressure applied at the drilling string (not illustrated) and other areas of the rotating blowout preventor 1 during the drilling operation is divided among the bottom stripper rubber 34 and top stripper rubber 100 to minimize deformation of the bottom stripper rubber 34. This well pressure may also be partially offset in either or both of the bottom shaft pressure seals 66 at the bottom end of the shaft 46, by means of pressurized lubricant inside the bearing assembly 17 through the lubricant fitting 75, the top seal box 71 and through the bottom seal box 62 on the top side of the respective bottom shaft pressure seals 66, which also serves to cool the bottom shaft pressure seals 66. Accordingly, well pressure exerted against those key outside shaft pressure seals 66 which are particularly vulnerable to well pressure is partially offset by lubricant pumped into the lubricant fitting 75, through the top bearing 69 and oilers **75*a*, into the bottom bearing 64 by a pump (not illustrated) which exerts a predetermined internal pressure on the bottom set of outside shaft pressure seals 66. Lubricant pressure is applied to this bottom set of outside shaft pressure seals 66, the lubricant being forced past the bottom set of outside shaft pressure seals 66**, into the well.

It will be appreciated by those skilled in the art that the rotating blowout preventor of this invention is designed to solve a number of problems during the drilling and operation of an oil or gas well. For example, a common problem realized in application of high well pressure to one or more stripper rubber elements located in conventional rotating blowout preventors or heads is deformation of the stripper rubber or rubbers and bypassing the well pressure past the stripper rubber(s), sometimes causing equipment damage or injury to personnel. This shortcoming is eliminated in the rotating blowout preventor of this invention, wherein water or other liquid is injected into the shaft annulus to hydraulically stabilize at least two spaced stripper rubbers. Since the water or other liquid pressure may be adjusted to any desired level, the rotating blowout preventor is designed to handle substantial well pressure which may be encountered during drilling or well operation. In a preferred embodiment, the pressure of the fluid introduced into the water inlet port 58 may be monitored at the quick-disconnect fitting 56 by means of a pressure gauge (not illustrated) and a pump (not illustrated) may also be attached to the quick-disconnect fitting 56. A chilled water system (not illustrated) is connected to the seal box water ports 70 by means of appropriate fittings (not illustrated) for circulating chilled water through the top seal box 71 between the top set of outside shaft pressure seals 66 for optimizing the life of the top set of outside shaft pressure seals 66.

The pressure inside the shaft 46, outside the top stripper rubber 100 and inside the bottom stripper rubber 34, is maintained by the pressure regulator not illustrated and pump at about one-half the well pressure, which may be monitored at the mud fill line 3 or at other selected points, by pumping water into the water inlet port 58. Lubricant is also pumped through the top bearing 69 and bottom bearing 64, as described above. Furthermore, stabbing or insertion of the drilling string and drill bit through the blowout preventor, as well as swaying and vibration of the drilling rig and other movement of the bearing assembly 17 and swivel ball 18 with respect to the bowl 2, sometimes causes damage. This problem is solved by mounting the bearing assembly 17 and swivel ball 18 in swiveling relationship with respect to the bowl 2 to compensate for any such movement, as further described above. The additional features of clamping the bottom stripper rubber 34 and top stripper rubber 100 to the respective mounting elements with quick-disconnect clamps serve to better facilitate a tight seal onto the shaft 46 and pot lid 81 for optimum assembly and disassembly of the top stripper rubbers 100 and bottom stripper rubber 34. Coupling of the kelly driver 91 to the kelly (not illustrated) is made more efficient by using the dual split kelly driver 91.

It will be further appreciated that although a single pair of stripper rubbers are used in a most preferred embodiment of the invention, additional stripper rubbers may be added, as desired. Accordingly, while the preferred embodiments of the invention have been described above, it will be recognized and understood that various modifications may be made therein and the appended claims are intended to cover all such modifications without departing from the spirit and scope of the invention.

Having described my invention with the particularity set forth above, what is claimed is:

1. A rotating blowout preventor adapted to seal against a rotatable drill string or other rotatable tubular member extending downhole in a well, comprising:

a first stationary housing section having a bore therethrough, said bore having a generally concave portion;

a bowl member having a convex exterior portion and a bore therethrough adapted to receive said drill string, said bowl member being mounted in said first stationary housing bore in tiltable engagement with said generally concave portion of said stationary housing;

a second generally cylindrical stationary housing section having a bore therethrough;

a generally cylindrical rotatable shaft member having a bore therethrough adapted to receive said drill string, and having upper and lower end portions, and bearing means mounted with said second housing section and said rotatable shaft member for mounting said rotatable shaft member for rotation with respect to said first and second stationary housing sections;

upper and lower rotatable seal members attached to said upper and lower end portions of said rotatable shaft, respectively, and adapted to receive and seal against said rotatable drill string, said rotatable shaft member and first and second seal members being tiltable with said bowl member for accommodating non-vertical positioning of a drill string.

2. The rotating blowout preventor of claim 1, further comprising:

bowl clamping means for releasable connecting said bowl member to said second stationary housing section.

3. The rotating blowout preventor of claim 1, further comprising:

said bowl member being sealably mounted with respect to said first and second stationary housing sections.

4. The rotating blowout preventor of claim 1, further comprising:

each of said rotatable seal members being generally cylindrical in shape but having a bore therein which is downwardly converging and adapted to receive said drill string, and rotatable, releasable clamp means being attached to said rotatable shaft and said lower rotatable seal member for releasably connecting said lower seal member to said shaft.

5. The rotating blowout preventor set forth in claim 1, further comprising:

said second stationary housing section, bearing means and said rotatable shaft having means for injecting in the annular space between said drill string and said rotatable shaft and said seal members a pressurized liquid for enhancing the sealability of said seam members.

6. The rotating blowout preventor set forth in claim 1, further comprising:

a generally cylindrical pot member being attached to said upper end of said rotatable shaft member, said pot member having a bore therethrough, and means mounting said upper seal member within said pot member and for rotation with said pot member, said rotatable shaft and said lower seal member.

7. The rotating blowout preventor set forth in claim 6, further comprising:

rotatable, releasable clamp means for releasably connecting said upper seal member to said pot member.

8. The rotating blowout preventor set forth in claim 1, further comprising:

seal means for sealing between said rotatable shaft member and said second stationary housing section; and, means for providing liquid coolant to said seal means.

9. The blowout preventor of claim 1, further comprising:

said lower, rotatable seal member being partially positioned in said bore of said bowl member.

* * * * *